US010681978B2

(12) United States Patent
Lim et al.

(10) Patent No.: US 10,681,978 B2
(45) Date of Patent: Jun. 16, 2020

(54) SHELVING ASSEMBLY HAVING AN ADJUSTABLE BRIDGE SHELF

(71) Applicant: Seville Classics Inc., Torrance, CA (US)

(72) Inventors: Gary Lim, Palos Verdes Peninsula, CA (US); James Sokol, Brea, CA (US)

(73) Assignee: Seville Classics Inc., Torrance, CA (US)

( * ) Notice: Subject to any disclaimer, the term of this patent is extended or adjusted under 35 U.S.C. 154(b) by 0 days.

(21) Appl. No.: 16/183,291

(22) Filed: Nov. 7, 2018

(65) Prior Publication Data

US 2020/0138187 A1 May 7, 2020

(51) Int. Cl.
*A47B 61/00* (2006.01)
*A47B 96/02* (2006.01)
(Continued)

(52) U.S. Cl.
CPC ..... *A47B 61/00* (2013.01); *A47B 45/00* (2013.01); *A47B 47/0041* (2013.01); *A47B 47/0058* (2013.01); *A47B 47/0083* (2013.01); *A47B 47/021* (2013.01); *A47B 47/022* (2013.01); *A47B 47/027* (2013.01); *A47B 47/04* (2013.01); *A47B 55/02* (2013.01); *A47B 87/001* (2013.01); *A47B 87/008* (2013.01); *A47B 96/021* (2013.01); *A47F 5/0031* (2013.01);
(Continued)

(58) Field of Classification Search
CPC ..... A47B 61/00; A47B 47/022; A47B 47/027; A47B 47/04; A47B 96/021; A47B 47/0091; A47B 47/0025; A47B 47/0041; A47B 47/005; A47B 47/0058; A47B 47/0083; A47B 47/02; A47B 47/021; A47B 87/00; A47B 87/001; A47B 87/005; A47B 87/007; A47B 87/008; A47B 87/02; A47B 87/0207; A47B 87/0276; A47B 87/0284; A47B 55/02; A47B 57/00; A47B 73/002; A47B 61/003; A47B 45/00; A47B 47/00; A47F 5/10; A47F 5/13; A47F 5/0031; A47F 5/00; A47F 5/0018; A47F 5/01; A47F 5/14
USPC ..... 211/191, 123, 194, 188, 187, 186, 134, 211/189, 181.1, 204, 206, 175; 108/27, 108/106–110, 180, 186, 187, 147.11; 312/107, 108, 111, 238
See application file for complete search history.

(56) References Cited

U.S. PATENT DOCUMENTS 3,730,601 A * 5/1973 Misenheimer, III ..... A47B 87/0215 312/108
3,756,168 A * 9/1973 Bushyhead ..... A47B 57/26 108/190
(Continued)

*Primary Examiner* — Jennifer E. Novosad
(74) *Attorney, Agent, or Firm* — Raymond Sun

(57) ABSTRACT

A closet organizer assembly has a first tower unit and a second tower unit, each tower unit having a plurality of shelves separated by vertical posts, each tower unit also having a plurality of top vertical posts, and a cantilevered shelf removably connected to the plurality of top vertical posts, with each cantilevered shelf having a border wall that includes a plurality of border wall openings. The assembly also includes a bridge shelf having a left end that is removably connected to the cantilevered shelf of the first tower unit, and a right end that is removably connected to the cantilevered shelf of the second tower unit.

12 Claims, 7 Drawing Sheets

(51) Int. Cl.

| | |
|---|---|
| ***A47B 47/02*** | (2006.01) |
| ***A47B 47/04*** | (2006.01) |
| ***A47B 47/00*** | (2006.01) |
| ***A47F 5/14*** | (2006.01) |
| ***A47B 45/00*** | (2006.01) |
| ***A47F 5/13*** | (2006.01) |
| ***A47F 5/10*** | (2006.01) |
| ***A47F 5/00*** | (2006.01) |
| ***A47B 87/00*** | (2006.01) |
| ***A47B 55/02*** | (2006.01) |
| ***A47F 5/01*** | (2006.01) |

(52) U.S. Cl.
CPC ..... *A47F 5/01* (2013.01); *A47F 5/10* (2013.01); *A47F 5/13* (2013.01); *A47F 5/14* (2013.01)

(56) References Cited

U.S. PATENT DOCUMENTS 3,948,581 A * 4/1976 Heiman ..... A47B 47/05 312/198
4,099,472 A * 7/1978 Kellogg ..... A47B 87/0246 108/101
4,805,785 A * 2/1989 Pfeifer ..... A47B 87/0207 211/181.1
4,919,280 A * 4/1990 Phillips ..... A47F 5/08 211/187
4,928,833 A * 5/1990 Huizenga ..... A47B 95/008 108/152
4,934,858 A * 6/1990 Beaulieu ..... F16B 12/40 403/174
5,195,642 A * 3/1993 Dardashti ..... A47B 81/06 211/189
5,588,541 A * 12/1996 Goetz ..... A47B 87/008 211/186
5,601,038 A * 2/1997 Welch ..... A47B 55/02 108/107
5,752,610 A * 5/1998 Remmers ..... A47B 55/02 108/181
5,913,270 A * 6/1999 Price ..... A47J 37/0763 108/101
6,230,632 B1 * 5/2001 Moore ..... A47B 47/00 108/180
6,644,484 B1 * 11/2003 Sardis ..... A47B 43/00 211/189
8,905,247 B2 * 12/2014 Artigues ..... A47F 5/0018 211/187
2002/0130098 A1 * 9/2002 Simard ..... A47F 5/01 211/181.1
2004/0256337 A1 * 12/2004 Humberto ..... A47B 61/00 211/87.01
2006/0054063 A1 * 3/2006 Ryan, Jr. ..... A47B 47/0083 108/27
2006/0157435 A1 * 7/2006 Oberhaus ..... A47B 57/12 211/187
2006/0169659 A1 * 8/2006 Robinson ..... A47B 57/30 211/187
2007/0095773 A1 * 5/2007 Schwerman ..... A47B 47/0091 211/187
2007/0108147 A1 * 5/2007 Chen ..... A47B 47/00 211/187
2007/0227994 A1 * 10/2007 Cho ..... A47B 47/005 211/188
2008/0302748 A1 * 12/2008 Tsai ..... A47B 45/00 211/188
2009/0184078 A1 * 7/2009 Lee ..... A47B 57/54 211/187
2011/0220602 A1 * 9/2011 Chen ..... A47B 57/12 211/153
2011/0233164 A1 * 9/2011 Chang ..... A47B 57/14 211/188
2012/0031863 A1 * 2/2012 Horn ..... A47B 47/0083 211/59.2
2012/0298607 A1 * 11/2012 Chen ..... A47B 47/024 211/186
2014/0263135 A1 * 9/2014 Sabounjian ..... A47B 47/0058 211/186
2014/0353271 A1 * 12/2014 Kruse ..... A47F 5/01 211/188
2016/0073774 A1 * 3/2016 Lim ..... A47B 47/00 211/188
2017/0065078 A1 * 3/2017 Sabounjian ..... A47B 47/0083
2017/0215579 A1 * 8/2017 Cooper ..... A47B 47/0083

* cited by examiner

SHELVING ASSEMBLY HAVING AN ADJUSTABLE BRIDGE SHELF

BACKGROUND OF THE INVENTION

1. Field of the Invention

The present invention relates to a shelving assembly, and in particular, to a shelving assembly that has two columns of shelves, and an adjustable bridge shelf that connects the two columns.

2. Description of the Related Art

"Knock-down" or portable shelving assemblies have become very popular. There are many different types of shelving assembles that can be adapted for use in many different locations around the house. One type of shelving assembly is a closet organizer assembly that has two tower units, and a bridge shelf that connects at the top to cantilevered shelves extending from each tower unit.

Because closets in different rooms come in different sizes, it is important for the user to be able to adjust the closet organizer assembly to fit the dimensions of the specific closets. In this regard, the length of the bridge shelf may need to be adjusted to fit the specific closet that it is to be used in. Thus, there remains a need for a closet organizer assembly that provides an adjustable bridge shelf that can be conveniently and effectively adjusted to fit into almost any closet.

SUMMARY OF THE INVENTION

To accomplish the objectives of the present invention, there is provided a closet organizer assembly having a first tower unit and a second tower unit, each tower unit having a plurality of shelves separated by vertical posts, each tower unit having a plurality of top vertical posts, and a cantilevered shelf removably connected to the plurality of top vertical posts, with each cantilevered shelf having a border wall that includes a plurality of border wall openings. The assembly also includes a bridge shelf having a left end that is removably connected to the cantilevered shelf of the first tower unit, and a right end that is removably connected to the cantilevered shelf of the second tower unit.

In one embodiment of the present invention, a hanging rod is provided, and has a first end that is connected to one of the plurality of shelves in the first tower unit, and a second end that is connected to one of the plurality of shelves in the second tower unit, with the hanging rod positioned below the cantilevered shelves.

In another embodiment, the bridge shelf includes a central shelf section, a front border frame and a rear border frame, with each border frame defining a plurality of border frame openings. A first connector assembly removably connects the left end of the bridge shelf to the cantilevered shelf of the first tower unit, and a second connector assembly removably connects the right end of the bridge shelf to the cantilevered shelf of the second tower unit, with each connector assembly having at least one rod that extends through an aligned pair of one border wall opening and one border frame opening.

In another embodiment, the bridge shelf has a horizontal central shelf section, a left end, and a right end, with the central shelf section having a front edge and a rear edge. The bridge shelf further includes a front vertical border frame provided along the front edge and a rear vertical border frame provided along the rear edge, with the front border wall adapted to slide along and be retained interior to the front vertical border frame, and the rear border wall adapted to slide along and be retained interior to the rear vertical border frame.

DESCRIPTION OF THE PREFERRED EMBODIMENTS

Figure 1:
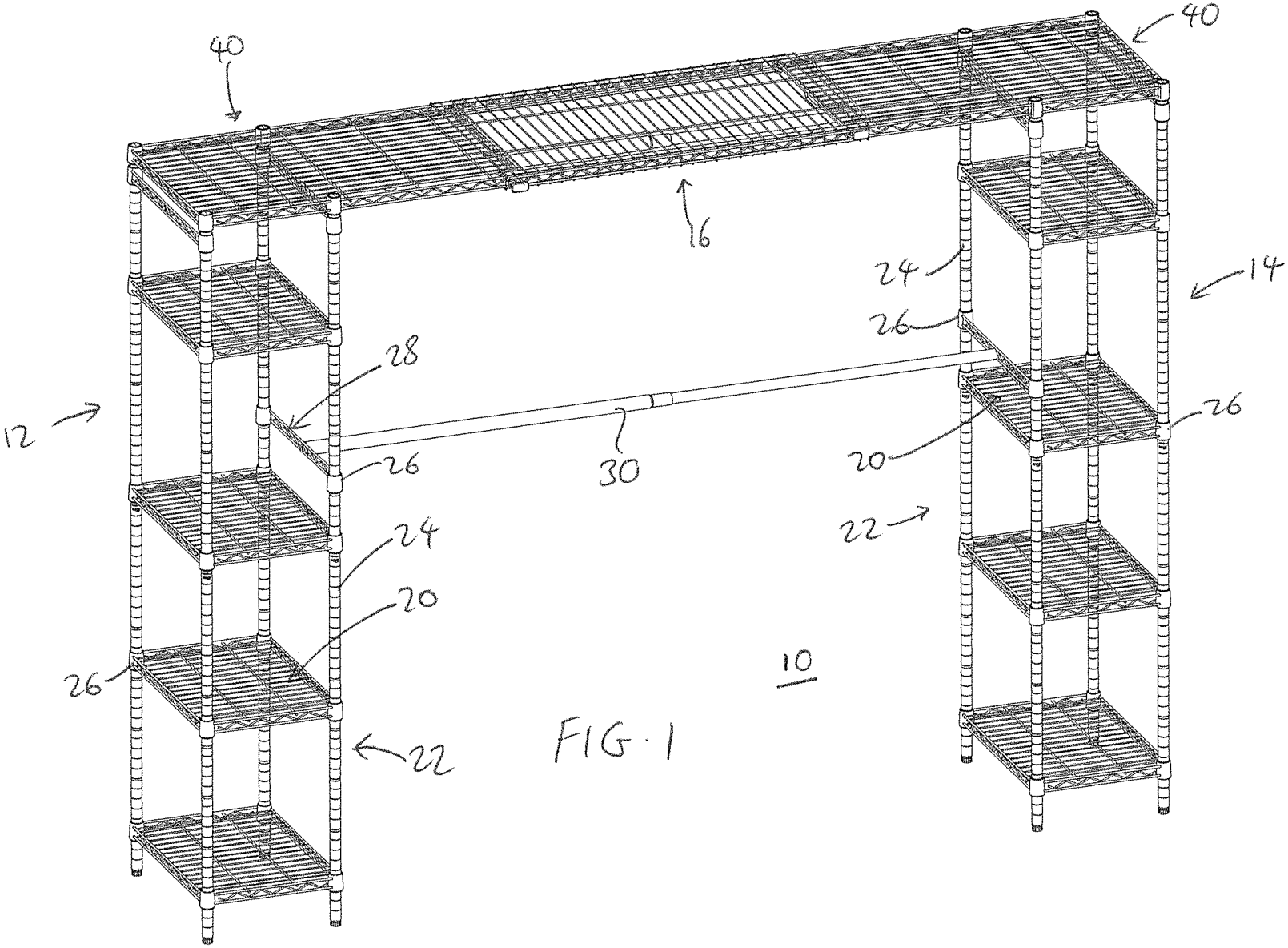
FIG. 1 is a perspective view of a closet assembly according to the present invention.
Figure 2:
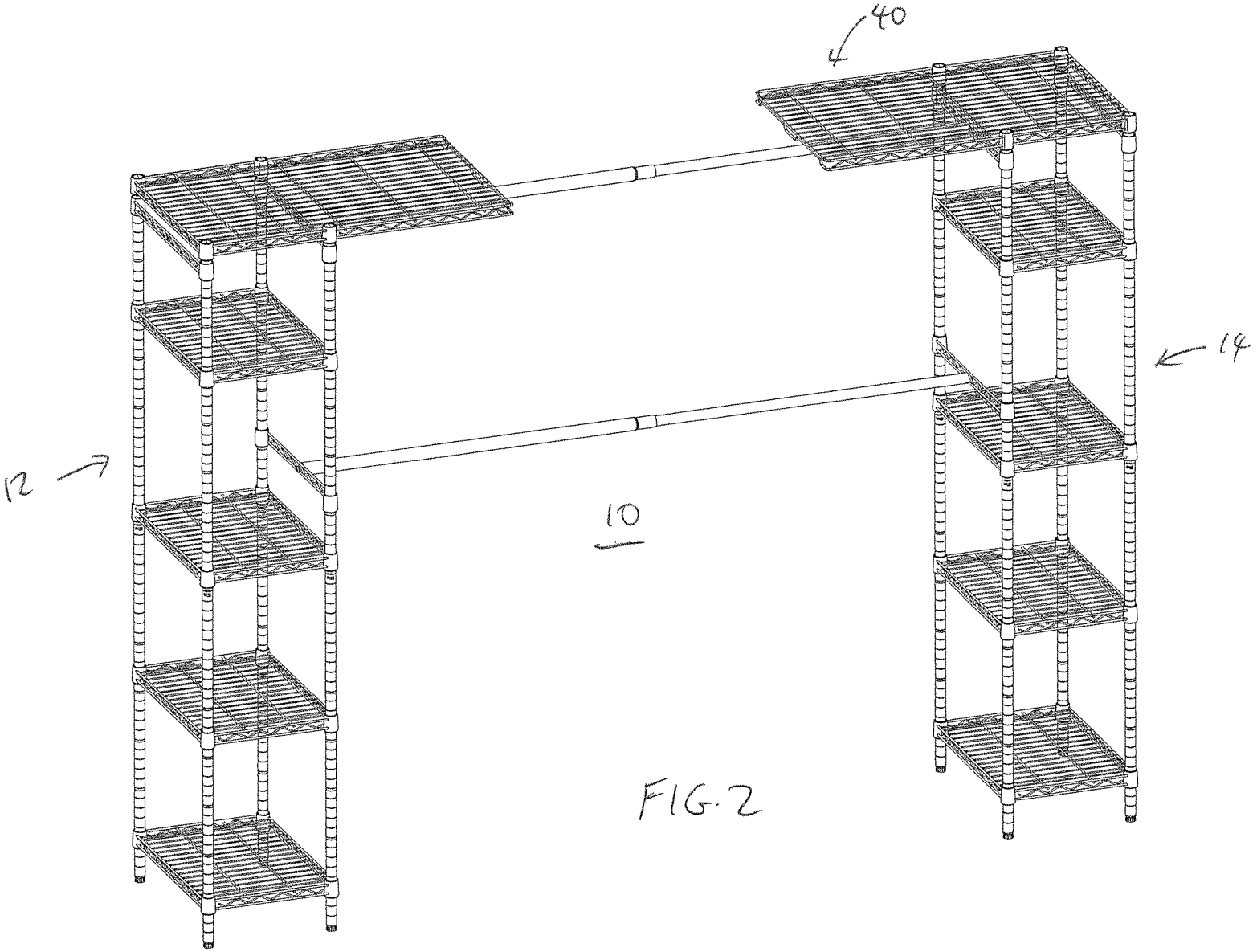
FIG. 2 is a perspective view of the closet assembly of FIG. 1 shown without the bridge shelf.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

As shown in FIGS. 1-5, the closet organizer 10 according to the present invention has a left tower unit 12 and a right tower unit 14 that is interconnected at the top by a bridge shelf 16.

Each tower unit 12 and 14 is identical, and has a plurality of shelves 20 that are spaced apart along the height of a frame 22. The frame 22 includes a plurality of vertical posts 24 that has opposing ends that are removably connected to shelf collars or connectors 26 provided at the corners of each shelf 20. Each connector 26 can be configured in the form of an open cylinder having two opposite open ends that function as connector joints, one on top of, and one below, the connector 26, so that each connector joint receives an end of a vertical post 24. The vertical posts 24 can be provided in different lengths to allow the user to vary the distance or height between adjacent shelves 20. In addition, it is possible to provide an end support 28 for a hanging rod 30. The end support 28 can also include two connectors 26 that allow the vertical posts 24 to be removably connected thereto. Alternatively, the opposite first and second ends of the hanging rod 30 can be connected directly to opposite and height-aligned shelves 20 on the two tower units 12, 14.

Each shelf 20 can be provided in the form of a wire shelf having a frame or border with wires extending across the border. The border and the wires can be made from one of a variety of materials, including a metal (e.g., stainless steel), a plastic, a type of resin, wood or bamboo. Each shelf can also have a rectangular or square shape, and can be provided in any desired size.

Figure 5:
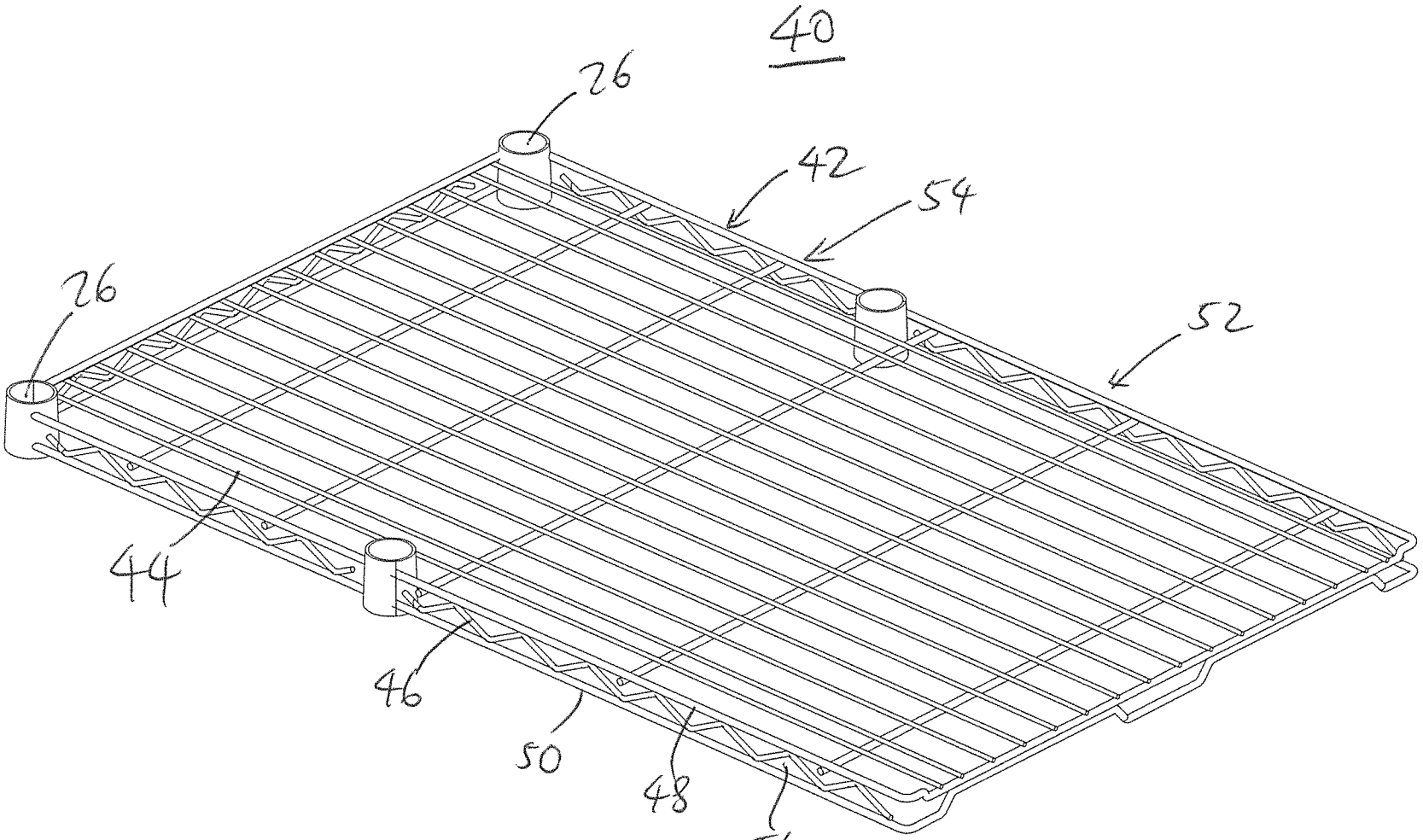
FIG. 5 is a perspective view of a cantilevered shelf of the present invention.

A cantilevered shelf 40 is removably coupled to the top of each tower unit 12, 14. Referring to FIG. 5, the cantilevered shelf 40 can also have a border 42 with shelf collars or connectors 26 provided at the locations corresponding to the top four vertical posts 24 in each tower unit 12, 14. Wires 44 can extend across the border 42. The border 42 can have a short border wall that is defined by a wavy (e.g., sinusoidal) or zig-zag wire 46 that is retained between an upper wire 48 and a lower wire 50, and which functions as a truss wire. Openings 56 are defined by the upper wire 48, the lower wire 50, and the zig-zags in the zig-zag wire 46. An extension section 52 can extend from the main part 54 of the cantilevered shelf 40, and is adapted to removably connect to the bridge shelf 16.

Figure 4:
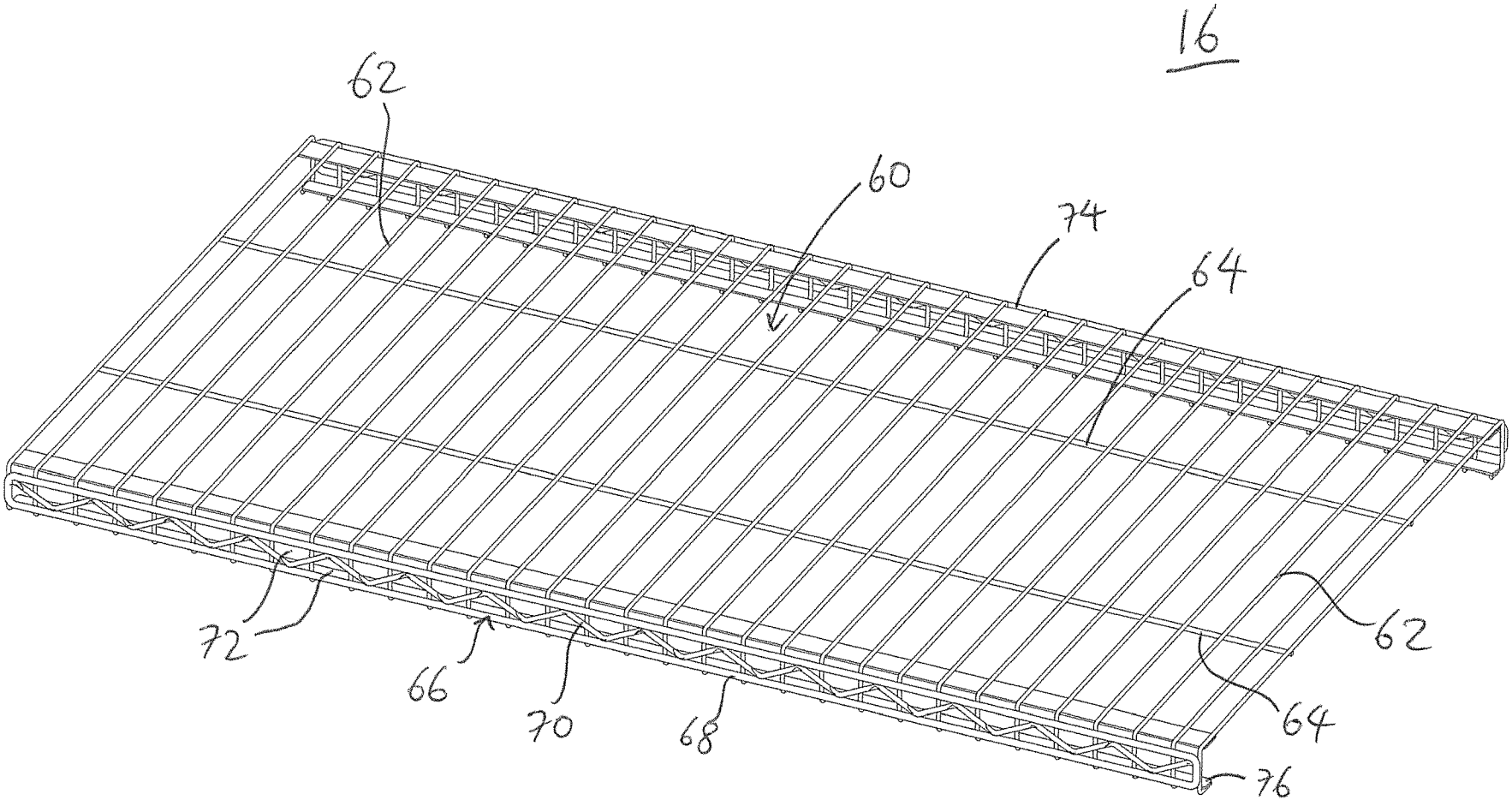
FIG. 4 is a perspective view of the bridge shelf of the present invention.

Referring to FIG. 4, the bridge shelf 16 has a central shelf section 60 that is made up of a plurality of parallel transverse wires 62 supported by one or more longitudinal wires 64. The wires 62, 64 can be made of the same material as the wires for the shelves 20 and 40. The opposite end of each wire 62 is bent by ninety degrees to define a front border and a rear border for the bridge shelf 16. A border frame 66 is provided along the front border and the rear border. Each border frame 66 is generally C-shaped, and has two horizontal strips 74 and 76, and a vertical bordering wire 68. A zig-zag wire 70 is housed inside the boundary of the bordering wire 68 and functions as a truss wire. Openings 72 are defined by the bordering wire 68 and the zig-zags in the zig-zag wire 70. The strips 74 and 76 can be elongated strips of metal material that are connected (e.g., welded) to portions of the wires 62, with the upper strip 74 positioned on the underside of the wires 62 along the central shelf section 60, and the lower strip 76 positioned inside the bent ends of the wires 62. The two opposing C-shaped border frames 66 are adapted to function as opposing rail for the borders 42 of the cantilevered shelves 40.

Figure 6:
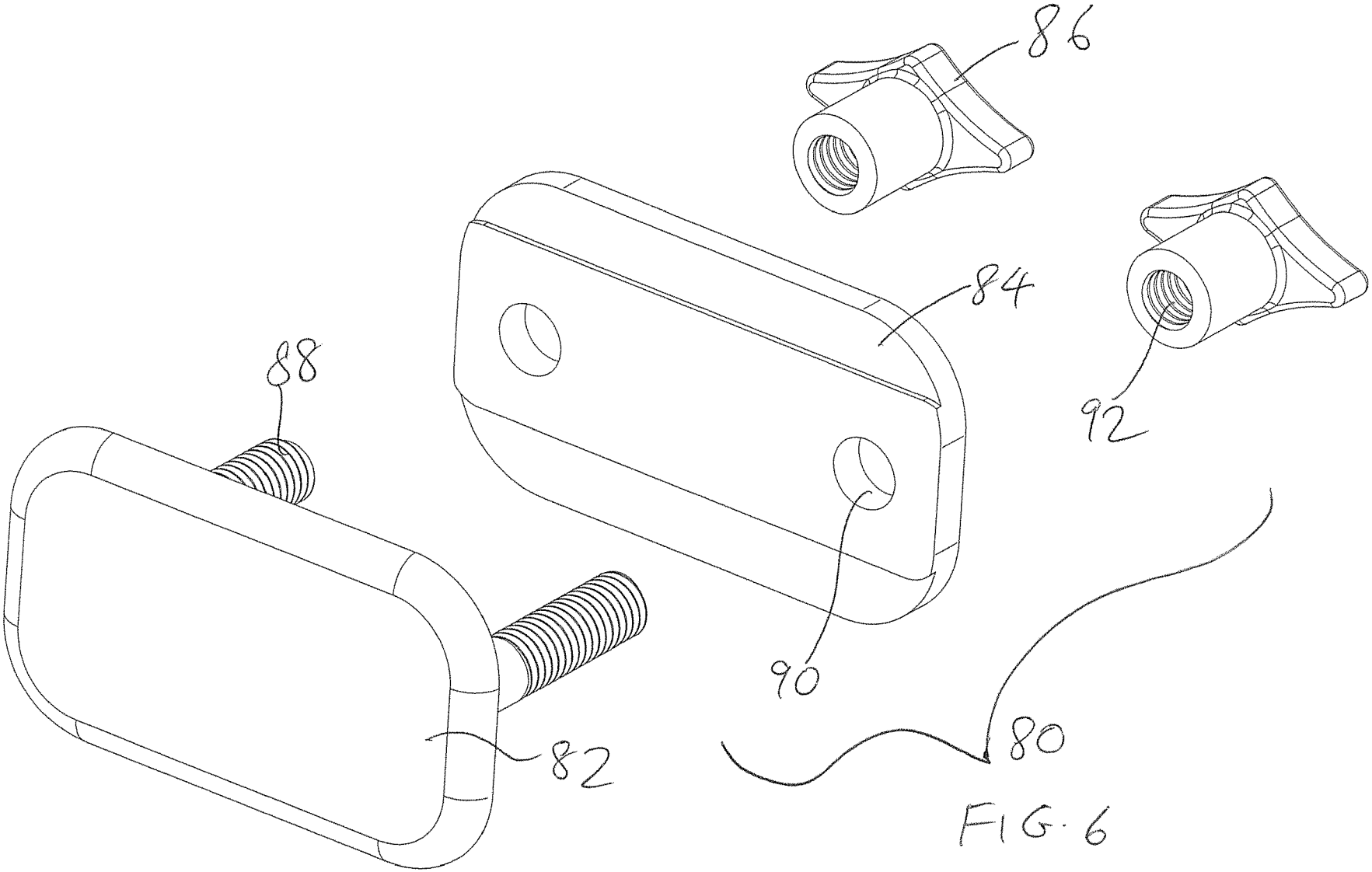
FIG. 6 is an exploded view of the connector assembly of the present invention.

FIG. 6 illustrates the connector assembly 80 that is used to removably connect the bridge shelf 16 to the cantilevered shelves 40. Four connector assemblies are needed, as two connector assemblies 80 are needed to connect opposing front and rear borders of the bridge shelf 16 to each cantilevered shelf 40. Each connector assembly 80 has one front plate 82, one rear plate 84, and two bolts 86. Two threaded bolts 88 extend from the rear of the front plate 82, and each extends through a corresponding opening 90 in the rear plate 84, before being secured by a threaded nut 92 of a corresponding bolt 86. Even though the present invention is being described as having threaded bolts 88, any rod-like element or clip mechanism that can extend through openings can also be used.

In use, the user unpacks all the shelves 16, 20 and 40 and the posts 24 from the box packaging, and begins assembly. The tower units 12 and 14 are assembled first by connecting ends of the posts 24 into the joints of the connectors 26. One cantilevered shelf 40 is then connected to the top of each tower unit 12, 14 in a manner where the extension sections 52 extend towards each other. See FIG. 2.

Figure 3:
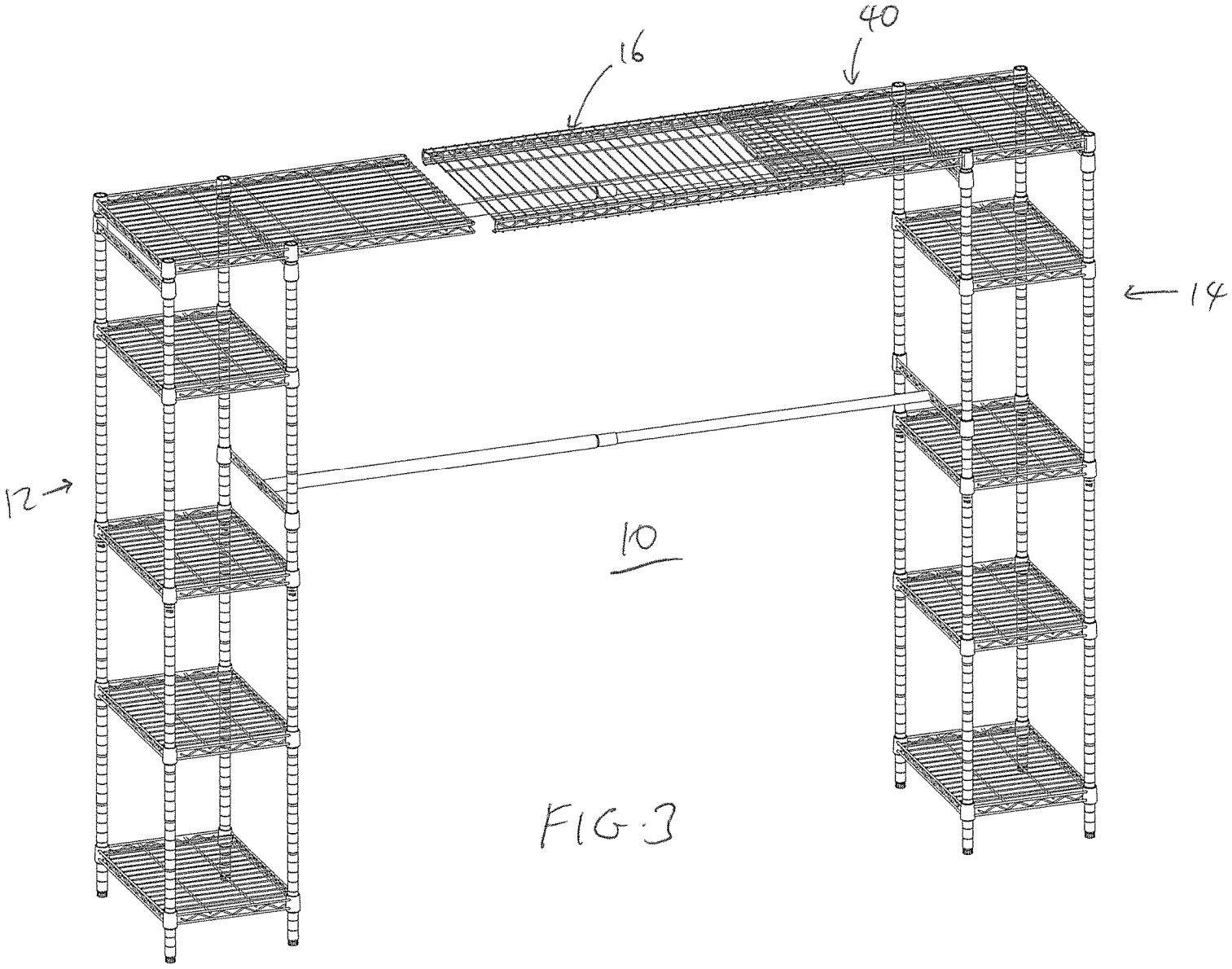
FIG. 3 is a perspective view of the closet assembly of FIG. 1 shown with the bridge shelf partially installed.

Next, the extension section 52 for one tower unit 12 or 14 is slid into the C-shaped border frames 66 of the bridge shelf 16. Specifically, one end of the bridge shelf 16 can be slid over the extension section 52 so that the borders 42 of that extension section 52 will slide into the rail track defined by the two C-shaped border frames 66. The same step is repeated for the other end of the bridge shelf 16 over the other extension section 52 for the other tower unit 14 or 12. Therefore, the front and rear border frames 66 of the bridge shelf 16 are positioned outside, or exterior to, the border 42 of the extension sections 52. Portions of the ends of the central shelf 60 will overlap, or lie on top of, portions of the extension sections 52, as best shown in FIGS. 1 and 3. The position of the bridge shelf 16 on top of the extension sections 52 can be adjusted by sliding the cantilevered shelves 40 along the rail track, depending on the size of the closet or room that the closet organizer 10 is to be used in.

Figure 7:
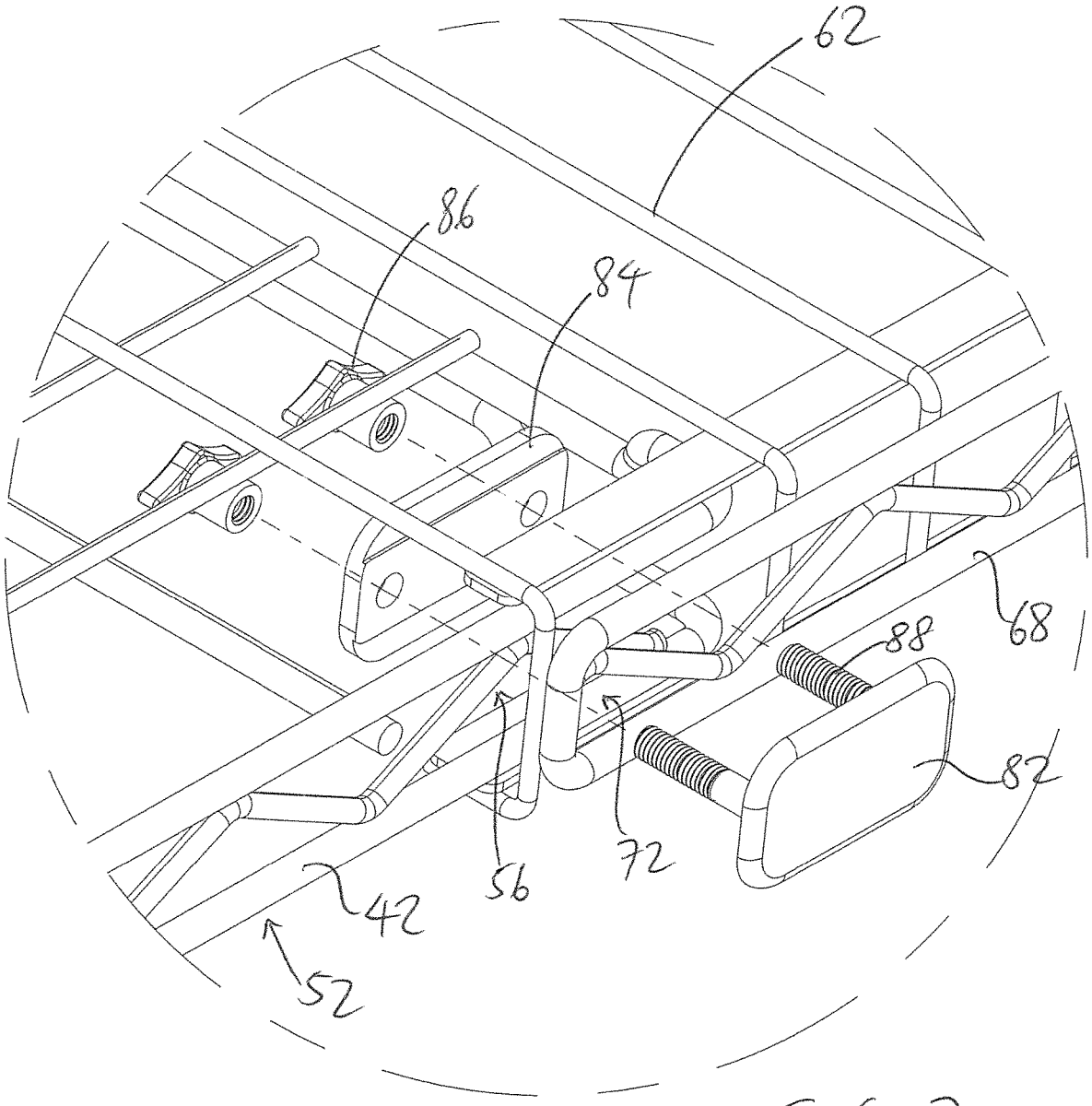
FIG. 7 illustrates how the connector assembly of FIG. 6 is used to adjustably connect one end of the bridge shelf to one cantilevered shelf.

Now, referring to FIG. 7, two sets of openings 56 and 72 are aligned, and a rear plate 84 is positioned interior of (inside) the border 42 of the extension section 52, and then a front plate 82 is positioned outside the border frame 66, with each threaded bolt 88 extending through adjacent sets of aligned openings 56 and 72, and through the openings 90 in the rear plate 84. The threaded nuts 86 are then used to secure the front plate 82 to the rear plate 84, thereby securing the bridge shelf 16 to the cantilevered shelf 40 at the specific location. Connector assemblies 80 can be used to secure the front and rear connections for each end of the bridge shelf 16 with each cantilevered shelf 40.

Thus, the present invention provides a closet organizer 10 which has a bridge shelf 16 that can be quickly installed on to the top thereof for use in a closet or room of any size. The connector assembly 80 and the alignment of the openings 56 and 72 in the border walls of the cantilevered shelves 40 and the bridge shelf 16 provide a simple yet effective way of allowing the user to adjust the position of the bridge shelf 16.

While the description above refers to particular embodiments of the present invention, it will be understood that many modifications may be made without departing from the spirit thereof.

What is claimed is:

1. A closet organizer assembly, comprising:

a first tower unit and a second tower unit, each tower unit having a plurality of shelves separated by vertical posts, each tower unit having a plurality of top vertical posts, and a cantilevered shelf removably connected to the plurality of top vertical posts, each cantilevered shelf having at least one border wall having a plurality of border wall openings;

a bridge shelf having a left end, a right end, and a central shelf section and having a front border frame and a rear border frame, each border frame defining a plurality of border frame openings; and a first connector assembly that removably connects the left end of the bridge shelf to the cantilevered shelf of the first tower unit, and a second connector assembly that removably connects the right end of the bridge shelf to the cantilevered shelf of the second tower unit, with each connector assembly having at least one rod that extends through an aligned pair of one border wall opening and one border frame opening.

2. The assembly of claim 1, wherein each connector assembly comprises a front plate having at least one rod, and a rear plate having an opening through the rod extends.

3. A closet organizer assembly, comprising:

a first tower unit and a second tower unit, each tower unit having a plurality of shelves separated by vertical posts, each tower unit having a plurality of top vertical posts, and a cantilevered shelf removably connected to the plurality of top vertical posts, each cantilevered shelf having at least one border wall that includes a plurality of border wall openings;

a bridge shelf having a left end that is removably connected to the cantilevered shelf of the first tower unit, and a right end that is removably connected to the cantilevered shelf of the second tower unit; and a hanging rod having a first end that is connected to one of the plurality of shelves in the first tower unit, and a second end that is connected to one of the plurality of shelves in the second tower unit, with the hanging rod positioned below the cantilevered shelves;

wherein the bridge shelf further includes a central shelf section and having a front border frame and a rear border frame, each border frame defining a plurality of border frame openings.

4. The assembly of claim 3, further including a first connector assembly that removably connects the left end of the bridge shelf to the cantilevered shelf of the first tower unit, and a second connector assembly that removably connects the right end of the bridge shelf to the cantilevered shelf of the second tower unit, with each connector assembly having at least one rod that extends through an aligned pair of one border wall opening and one border frame opening.

5. The assembly of claim 4, wherein each connector assembly comprises a front plate having at least one rod, and a rear plate having an opening through the rod extends.

6. A closet organizer assembly, comprising:

a first tower unit and a second tower unit, each tower unit having a plurality of shelves separated by vertical posts, each tower unit having a plurality of top vertical posts, and a cantilevered shelf removably connected to the plurality of top vertical posts, each cantilevered shelf having a front border wall and a rear border wall;

a bridge shelf having a horizontal central shelf section, a left end, and a right end, with the central shelf section having a front edge and a rear edge, the bridge shelf further including a front vertical border frame provided along the front edge and a rear vertical border frame provided along the rear edge;

wherein the front border wall is adapted to slide along and be retained interior to the front vertical border frame, and the rear border wall is adapted to slide along and be retained interior to the rear vertical border frame; and wherein the left end is removably connected to the cantilevered shelf of the first tower unit, and the right end that is removably connected to the cantilevered shelf of the second tower unit.

7. The assembly of claim 6, wherein each border frame is C-shaped and defines a rail track.

8. The assembly of claim 7, wherein each border frame has two horizontal strips and a vertical bordering wire.

9. The assembly of claim 8, wherein the bordering wire has a boundary, and a zig-zag wire is housed inside the boundary of the bordering wire and defining border frame openings.

10. The assembly of claim 6, further including a hanging rod having a first end that is connected to one of the plurality of shelves in the first tower unit, and a second end that is connected to one of the plurality of shelves in the second tower unit, with the hanging rod positioned below the cantilevered shelves.

11. The assembly of claim 6, wherein each border frame defines a plurality of border frame openings, and the border wall of each cantilevered shelf have a plurality of border wall openings, the assembly further including a first connector assembly that removably connects the left end of the bridge shelf to the cantilevered shelf of the first tower unit, and a second connector assembly that removably connects the right end of the bridge shelf to the cantilevered shelf of the second tower unit, with each connector assembly having at least one rod that extends through an aligned pair of one border wall opening and one border frame opening.

12. The assembly of claim 11, wherein each connector assembly comprises a front plate having at least one rod, and a rear plate having an opening through the rod extends.

* * * * *